United States Patent [19]

Guijarro

[11] Patent Number: 4,923,113

[45] Date of Patent: May 8, 1990

[54] CONTAINER WITH A PERFECTED LID

[75] Inventor: Francisco I. Guijarro, Alicante, Spain

[73] Assignee: Iberoamer icana Del Ambalaje S.A., Spain

[21] Appl. No.: 203,427

[22] Filed: Jun. 7, 1988

[30] Foreign Application Priority Data

Jan. 25, 1988 [ES] Spain ..... 8800162

[51] Int. Cl.[5] ..... B65D 5/22

[52] U.S. Cl. ..... 229/125.27; 229/125.28; 229/125.31; 229/174; 229/178; 229/918; 229/919; 229/DIG. 11

[58] Field of Search ..... 229/125.27, 125.28, 229/125.31, 125.36, 174, 178, 182, 915, 918, 919, DIG. 11, 125.26, 191

[56] References Cited

U.S. PATENT DOCUMENTS

| | | | |
|---|---|---|---|
| 1,341,429 | 5/1920 | Lewis | 229/125.28 |
| 1,874,702 | 8/1932 | Gomes | 229/174 |
| 1,936,136 | 11/1933 | Lindgren | 229/182 |
| 2,295,141 | 9/1942 | Van Wingen | 229/174 |
| 2,588,232 | 3/1952 | Grant | 229/23 R |
| 2,676,749 | 4/1954 | Argodale | 229/125.28 |
| 2,736,486 | 2/1956 | Rabby | 229/125.26 |
| 2,858,059 | 10/1958 | Kitchell | 229/125.28 |
| 2,894,672 | 7/1959 | Bamburg | 229/178 |
| 3,342,322 | 9/1967 | Weisner et al. | 229/178 |
| 3,447,672 | 6/1969 | Bailey et al. | 229/125.28 |
| 3,498,492 | 3/1970 | McCrea | 229/125.28 |
| 4,151,948 | 5/1979 | de La Fuente, Jr. | 229/178 |

FOREIGN PATENT DOCUMENTS

| | | | |
|---|---|---|---|
| 2446231 | 9/1980 | France | 229/DIG. 11 |
| 751638 | 7/1956 | United Kingdom | 229/125.28 |
| 2043596 | 10/1980 | United Kingdom | 229/DIG. 11 |

*Primary Examiner*—Gary Elkins

*Attorney, Agent, or Firm*—Ostrolenk, Faber, Gerb & Soffen

[57] ABSTRACT

A container includes a rectangular tray and a removable lid. Each short side of the tray is constructed of two closely spaced walls or partitions and the lid is provided with extensions each of which projects through a slot in the narrow connecting section that joins each pair of short side walls and extends into the space therebetween. With a plurality of these tray in a stack, the connecting sections provide ledges on which each of these trays supports the adjacent higher tray. For each pair of short side walls, the inner one thereof is provided with a panel at both ends thereof. Each panel has an end or distal section that overlaps and is cemented to the adjacent long side wall and a joining or connecting section that extends diagonally between this long side wall and the main central section of the short wall. These joining sections serve to support the adjacent upper tray in the stack. For each pair of short side walls the outer one thereof is provided with a tab that is bent at right angles to the main central section of the outer wall and is cemented to the outer surface of the adjacent long side wall. To stabilize the stack, the tab and adjacent portion of the outer wall extend above the tops of the long sides and are received in cutouts of the next upper tray at the bottom of the tab and the bottom of the adjacent outer wall.

5 Claims, 2 Drawing Sheets

Figure 1:
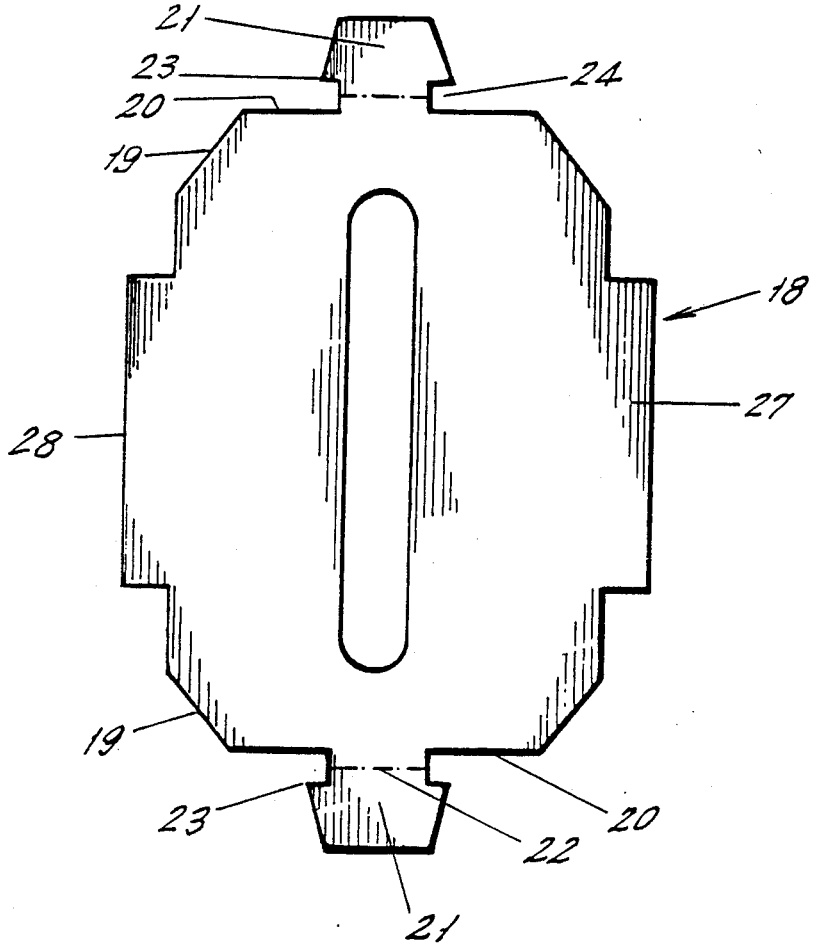

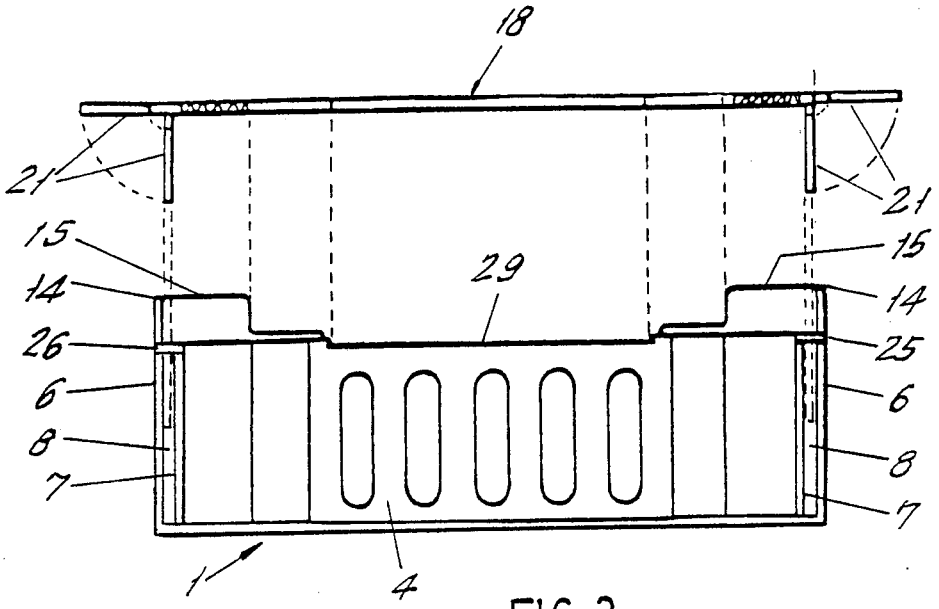
FIG. 2
FIG. 3
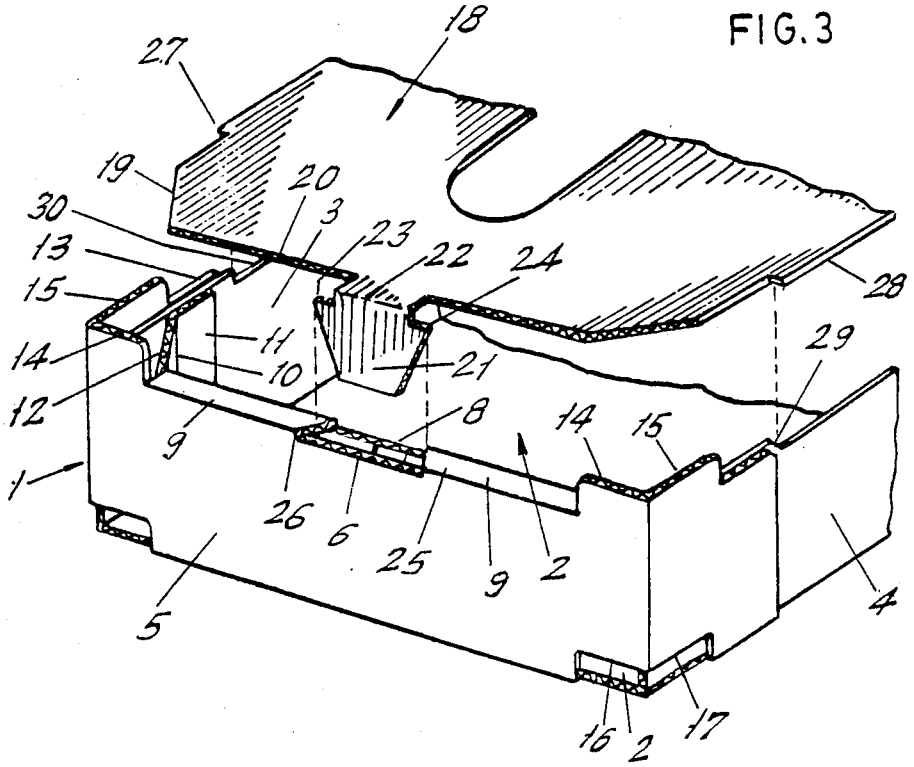

CONTAINER WITH A PERFECTED LID

SUMMARY OF THE INVENTION

The primary object of the invention is to provide container with an improved lid, and having a seating and housing that makes it possible to superimpose several containers successively, forming stacks.

At the upper edge of two of its opposite sides, notches have been made which form each of two spaces or openings that are capable of receiving, into the cavity of the said sides, the respective orthogonal flaps which jut out from the opposite sides of a sheet which acts as a closing lid for the container, and these orthogonal flaps have each of two projections at each side, which act like buffers to impede accidental shifting of the lid which is kept held onto the container.

The container that is constructed according to teachings of this invention can be used as a package for products in general and particularly for perishable products.

HISTORY OF THE INVENTION

Several types of open boxes, i.e. without a lid, are known, which are made from one punched out sheet of flexible laminar material, usually from corrugated cardboard, and these boxes are shaped by the corresponding moulding process that is carried out in machines that have been especially conceived for this purpose. These open boxes are also known by the name of "trays" and they are normally used for the packaging and transportation of perishable products, such as fresh fruit which has to be kept well aired to avoid quick deterioration.

For these reasons these boxes are deprived of a lid, since they must of necessity be kept open to avoid deterioration of the packaged products.

In some circumstances these containers are used to transport certain products, that are also perishable, and which have other characteristics, which happens with some vegetables, in which case the airing conditions are not so strict and the well-known boxes are not very appropriate for packaging these products.

Likewise, for transportation in container lorries, ships and planes, the well-known boxes are usually formed into stacks in which the trays situated on the lowest levels have to undergo quite considerable compression stress so that deterioration is easy, and there is the danger that the boxes forming the stack may fall.

It is precisely these very important problems that it is hoped to solve by the box with a lid that is proposed by the present invention.

DESCRIPTION OF THE INVENTION

The object of the present invention as indicated in the statement, is a tray or container which has been improved in its design, arrangement, and assembly characteristics, and which is made from a single stamped out sheet which is preferably but not exclusively of corrugated cardboard which is shaped by the pertinent moulding process that is preferably made in a machine which has been especially designed for this purpose.

Another object of the invention is to provide a tray that has its own means to superimpose it on another equal or similar one and at the same time receive another tray, thereby making it possible to form very stable stacks of trays.

Another objective of the tray is to constitute a container, preferably tray type, which has a mechanism to receive a sheet of special design and likewise of corrugated cardboard, which acts as a lid, and which is provided with arrangements to be held onto the tray covering its opening.

Another objective of the invention is to provide a sheet for closing the container, and which is held onto the tray in a permanent way, once it is put onto it, so that it cannot shift accidentally.

Another object of the invention is to provide a closing sheet which fits closely onto the upper edge of the tray and held into position, without obstructing the seating and housing arrangements that the said tray has, so that another equal tray can be placed on top and adjusted; in this way the trays, with their corresponding fitted lid can be superimposed forming stacks.

Other objectives related with the benefits and economy provided by the container which is the object of the invention, will be pointed out further on.

One characteristic of the invention is due to the fact that the container or box proposed, has seating and housing means to enable it to be superimposed on another equal or similar tray, and is also capable of receiving and holding another similar tray arranged on it.

Another characteristic of the box that the invention refers to is due to the fact that each of its facings is comprised of two small partitions, reciprocally joined forming a double wall and between these partitions a fitment is formed in which a laminar lug is received which is prolonged orthogonically from each coinciding edge of the sheet that comprises the lid.

A further characteristic of the invention has meant that the lid indicated has each of two lugs in the centre of its shortest sides, coinciding with the facings of the tray, with each of two lugs of special design deflected orthogonically downwards which are introduced into the fitment formed between the reciprocally adjoined small partitions that form each side, and they are held in this fitment and cannot slip out accidentally.

A further characteristic of the tray under discussion is due to the fact that the outline of the lid has been specifically designed so that when it is fitted onto the tray, it leaves the seating and housing mechanisms that the tray has, completely free, so as not to hinder the fitting of one tray onto another.

A more complete idea of the object of the invention, is obtained from the following description that appears illustrated by two sheets of drawings in which the whole and preferred details of the idea of the invention are represented in a somewhat sketchy manner, by way of a non-limitative means of example, referred to a possible case where it is put into practice.

In the drawings:

FIG. 1 is to a plan view of a lid with the characteristics that the invention proposes, which also shows its end appendages which are introduced into the respective fitments, formed between the two adjoined partitions that make up the facings of the container.

FIG. 2 is an exploded view in longitudinal cross-section showing the relationship between the lid of FIG. 1 and a tray constructed in accordance with the present invention, with the shorter sides or facings of the tray comprising two reciprocally adjoined partitions between which a suitable fitment is formed to receive and hold the orthogonical lugs that start from the corresponding edges of the lid.

FIG. 3 is an exploded fragmentary perspective, of the lid of FIG. 2 illustrative that on the upper edge of the corners, this tray has each of two ridges for housing and in the lower edge of the corners too it has a slotting into which the upper ridges of another box arranged on the next level down are fitted. The upper edge of the shortest sides likewise form a robust seating with their double wall on which another box rests which is superimposed when stacks are formed.

Now referring to the figures in which the body or tray of the container according to this invention is represented in general by reference number -1- while -2- is the base, 3 and 4 the longer sides and -5- the facings or shorter sides. Tray -1- is a rectangular parallelepiped body and each of its facings or short sidewalls -5- of double wall construction formed by closely spaced parallel partitions 6 and 7 which are joined lengthwise along their upper edges by very narrow connecting section 9. Partitions 6 and 7 are joined to longer sides 3,4 by adhesive which is applied strategically so that partitions 6 and 7 are arranged to form a free space -8- between them, into which a lug 21 of lid 18 is introduced, as explained further on.

On assembling the body of the tray -1-, the upper edge of the facings 5 will comprise the thickness of its two partitions -6- and -7- plus the space -8- formed between them, so that each facing 5 is connecting section or remarkably thick its upper edge 9 forms an ample seating surface on which another equal or similar tray (not shown) placed on the next level up, will rest very safely.

At each end thereof inside partition -7- of each facing -5- and forms a first diagonal sector or panel -1- which is extended from the inside surface of the facing -5- to the inside surface of the adjacent longer side -3- or 4. A second sector panel -11- is formed as a continuation of the first diagonal sector -10-. Sector 11 is pressed against the inside surface of the side -3- to which it is fixed by means of adhesive.

As seen in FIG. 3, due to its triple thickness, each facing -5- has its upper edge remarkably thick to constitute an efficient seating -9- on which another similar tray (not shown) that is placed on top of tray -1 will rest. This seating -9- is prolonged horizontally along the corners of the tray 1- by the upper edges -12-13- of the panel extensions -10- and -11-.

As we can also see in FIG. 3, the tray 1 discussed has an angular ridge formed by upwardly projecting bits 14, 15 at the upper edge of each of its corners. Bit -14- extends along the outer partition 6 of shorter side or facing and bit -15- extends along the adjacent one of the longer sides 3, 4. Coinciding with the aforementioned ridge forming bits -14- and -15-, the lower edge at each corner of the tray -1- has two cutouts which constitute slots 16-, -17 in partition -5- and side -3 or 4.

By means of these arrangements, several very resistant sectors are created in the upper edge of each tray 1. Each of these sectors is to support one tray on another, formed by the portions of base -1- that are identified by reference numerals -9-, -12-, -13-, -14- and -15-. The base -2- of an upper tray will rest on the seatings -9-, -12- and -13- and the cutouts -16- and -17- at each corner of the upper tray will receive bits -14-, -15- that project upward from the tray below. The upper edges of these bits -14- and -15- are aligned with and engage partition -5- and its adjacent longer side -3- -4.

These arrangements provide safe linking of one tray onto another and the upper tray will be fitted, materially connected, between the ridges -14-15- of each corner of the tray, making it practically impossible for them to shift sideways together.

As we have pointed out before, the box or tray -1 discussed is prepared for a lid 18 to be placed onto it. The latter is made of a punched out sheet of cardboard or equivalent material and this sheet is generally a rectangle with cut corners -19- forming an octagon in which each of the short edges -20- coincides with the facings -5- of the tray 1, have an appendage jutting out which comprise each of two lugs -21- which are turned downward by 90° so that they can be introduced through the elongated slot at the center of seating -9- into the space or fitment -8- produced between the partitions -6- and -7- which comprise the double wall of each facing -5-. Each of these lugs -21- have the shape of a quadrilateral-trapezium and is joined to the lid by a narrow band of material -22-. Projections -23-24- at the edge of the lug -21- comprise two buffers which will impede accidental removal of the said lugs 21 from the housing fitment -8- formed in the middle of each facing -5-, for which purpose these have a slot or groove made in upper edge -9-, which grooves receive the projections -23- and -24. The end boundaries 25-26 will form buffers to hold the lid -18- onto the upper edges of the tray.

The shape of the lid -18- has been studied so that when it is put onto the tray it does not cover the seatings formed on the edge of the facings -9- in the edges of the tray diagonals -12-13- and in the edge of the corner ridges -14-15-, so that they will serve as a support to the tray on the lowered edge of the facings, the extensions -22- from which the anchorage lugs -21- start, and on the edge of the longest sides -3-4- of the tray the extensions -27-28- of the longest sides of the lid 18 will lean. These longest sides have each of two cutouts -29-30- produced which are equivalent to the thickness of the sheet that forms the lid 18.

As we have pointed out, the special shape of the lid 18 allows the tray 1 to keep its bearing borders free when the lid -18- is fitted, so that the latter will not constitute any impediment for one tray 1 to be fitted and housed well onto another tray -1.

It should now be understood, after observing the drawings and from the above description, that the present idea provides a simple and effective construction which is liable to be put into practice very easily, assuring relatively cheap manufacturing.

It is reiterated, that all those modifications of detail that could be advised by circumstances and practice, can be introduced into the object that are embodied in the present invention, as long as these variations introduced do not change, alter or modify the essence of the embodiment described.

Although the present invention has been described in connection with a preferred embodiment thereof, many other variations and modifications should now be apparent to those skilled in the art. It is preferred, therefore, that the present invention be limited not by the specific disclosure herein, but only by the appended claims.

I claim:

1. A container, comprising:

(A) a rectangular tray, including:

(a) a base, said base including first spaced parallel edges and second spaced parallel edges;

(b) first and second sidewalls extending upward from said base along said first spaced parallel edges, said first and second sidewalls including closely spaced inner and outer partitions, each of said inner partitions including ends and a main central portion, said inner and outer partitions including upper edges, said inner and outer sidewalls including narrow connecting panels, said inner and outer partitions being joined along said upper edges by said narrow connecting panels, said first and second sidewalls including a free space between said inner and outer partitions; and (c) third and fourth sidewalls extending upward from said base along said second spaced parallel edges; and (B) a removable lid, said removable lid including a downwardly extending tab which is adapted to be received within said free space;

each end of said inner partitions being provided with an extension that comprises a distal portion and a joining portion, said distal portion being connected to and disposed adjacent the inner surface of the closer of said third and fourth sidewalls, said joining portion extending diagonally between the main central portion of the inner partition and the sidewall to which the distal portion is connected.

2. A container as set forth in claim 1 in which the joining portions have upper edges, said joining portions being disposed with their upper edges at the same height as that of the narrow connecting panels.

3. A container, comprising:

(A) a rectangular tray, including:

(a) a base, said base including first spaced parallel edges and second spaced parallel edges;

(b) first and second sidewalls extending upward from said base along said first spaced parallel edges, said first and second sidewalls including closely spaced inner and outer partitions, each of said inner partitions including ends and a main central portion, said inner and outer partitions including upper edges, said inner and outer sidewalls including narrow connecting panels, said inner and outer partitions being joined along said upper edges by said narrow connecting panels, said first and second sidewalls including a free space between said inner and outer partitions; and (c) third and fourth sidewalls extending upward from said base along said second spaced parallel edges; and (B) a removable lid, said removable lid including a downwardly extending tab which is adapted to be received within said free space;

each of said connecting panels being provided with an elongated slot, said tab of said removable lid being received within said free space by being inserted into said elongated slot, said slot being defined by converging end boundaries that are closer together at the inner partition than at the outer partition;

said lid having a main section with opposite edges positioned along said connecting panels, said opposite edges of said main section having respective centers, said lid including a second downwardly extending tab, said tabs including downwardly extending lugs, each of said lugs having two sides, said tabs including narrow sectors joining said lugs to said main section at the respective centers of said opposite edges of said main section, said tabs including projections at both sides of each lug constituting buffers that cooperate with said end boundaries of said slots to hold said lid closed with respect to said tray;

the main section of the lid being cut away along said opposite edges to leave said narrow connecting panels uncovered by said lid;

said third and fourth sidewalls including upper edges, the upper edges of the third and fourth sidewalls being positioned below said narrow connecting panels by the thickness of the main section of said lid, said lid having edge extensions that rest on the upper edges of said third and fourth sidewalls.

4. A container, comprising:

a rectangular tray, including:

(a) a base, said base including first spaced parallel edges and second spaced parallel edges;

(b) first and second sidewalls extending upward from said base along said first spaced parallel edges, said first and second sidewalls including closely spaced inner and outer partitions, each of said outer partitions including ends, said inner and outer partitions including upper edges, said inner and outer sidewalls including narrow connecting panels, said inner and outer partitions being joined along said upper edges by said narrow connecting panels, said first and second sidewalls including a free space between said inner and outer partitions, said free space being adapted to receive a downwardly extending tab of a removable lid; and (c) third and fourth sidewalls extending upward from said base along said second spaced parallel edges;

each end of said outer partitions being provided with an orthogonally deflected panel that is connected to and is disposed adjacent the outer surface of the closer of said third and fourth sidewalls, said outer partitions including limited portions adjacent to said deflected panels, each of each deflected panels and said limited portion of said outer partition adjacent thereto extending above said narrow connecting panels to constitute upwardly extending angular ridges that are received by corner cutouts at the bottom of a container tray stacked immediately above said container.

5. A container as set forth in claim 4 in which said inner partitions have ends and a main central portion, each end of said inner partitions being provided with an extension that comprises a distal portion and a joining portion;

said distal portion being connected to and disposed adjacent the inner surface of the closer of said third and fourth sidewalls;

said joining portion extending diagonally between the main central portion of the inner partition and the sidewall to which the adjacent distal portion is connected.

* * * * *